United States Patent [19]

Persson et al.

[11] 4,149,399

[45] Apr. 17, 1979

[54] METHOD OF FORMING TUBES OR PIPES

[75] Inventors: Hans Persson; Jan-Erik Söderström, both of Ystad, Sweden

[73] Assignee: AB Carbox, Ystad, Sweden

[21] Appl. No.: 867,762

[22] Filed: Jan. 9, 1978

[30] Foreign Application Priority Data

Jan. 11, 1977 [SE] Sweden ..... 7700221

[51] Int. Cl.[2] ..... B21D 51/10

[52] U.S. Cl. ..... 72/368; 113/116 UT

[58] Field of Search ..... 29/149.5 C, 149.5 DP; 72/51, 52, 368, 367, 370; 113/116 UT; 228/17.5, 146, 147, 148

[56] References Cited

U.S. PATENT DOCUMENTS

| | | | |
|---|---|---|---|
| 786,923 | 4/1905 | Smith | 72/368 |
| 1,866,257 | 7/1932 | Heineman | 113/116 UT |
| 3,166,827 | 1/1965 | Bushi | 29/149.5 DP |
| 3,693,398 | 9/1972 | Pedersen | 72/368 |

FOREIGN PATENT DOCUMENTS

| | | | |
|---|---|---|---|
| 18253 | 2/1976 | Japan | 72/368 |

*Primary Examiner*—E. M. Combs

*Attorney, Agent, or Firm*—Flynn & Frishauf

[57] ABSTRACT

In a method of forming tubes or pipes from a flat blank of a plastically deformable material, three spaced apart portions of the blank are first bent to the wanted curvature of the finished tube or pipe, so that two smaller unbent portions are obtained between the curved portions. Then, the blank is closed to essentially tubular form by means of forces acting on the curved portions, so that the principal deformation in connection with the closing is obtained in the unbent portions located between the curved portions.

6 Claims, 4 Drawing Figures

METHOD OF FORMING TUBES OR PIPES

BACKGROUND OF THE INVENTION

This invention relates to a method of forming tubes or pipes from a substantially flat blank of a plastically deformable material.

In forming of tubes or pipes from flat blanks of plastically deformable material such as steel plate using an upper movable die which coacts with a fixed lower die problems are encountered in attaining good roundness of the tube or pipe, as a complete closure of the blank cannot take place since the upper die has to pass through the wall of the tube or pipe. Even if the upper die is made with a slender web section the thickness of this when pressing heavy-gauge plates which require high pressing forces will be so great that the lengthwise slot obtained in the tube or pipe blank will adversely influence the final roundness of the tube or pipe, since in connection with the final pressing together of said slot further deformation will occur of part of the tube or pipe wall previously bent to the desired curvature.

In forming of large cylinders this problem may possibly be solved by utilization of a gap press stand or of a press stand with detachable end sections. This, however, is not possible in the case of long tubes or pipes or in the case of tubes or pipes with a relatively small diameter in relation to the plate thickness. The dimensions of the pressing tools, usually rollers, will then be too great in relation to the diameter of the tube or pipe.

A main object of the invention is to provide a method and apparatus for forming of tubes or pipes by bending of flat blanks, which gives very good roundness to the tubes or pipes even with long lengths and using thick blanks.

SUMMARY OF THE INVENTION

According to the invention, this aim is achieved by prebending of at least two mutually separated portions of the flat blank to the wanted curvature of the finished tube or pipe, so that at least one unbent portion is obtained between the curved portions, and by the blank subsequently being closed to essentially tubular form by means of forces acting on the curved portions, so that the principal deformation in connection with the closing is obtained in the unbent sections located between said curved portions. In said closing the maximum moment, if the forces are applied as above, will act on these unbent sections.

Preferably the blank is prebent over a portion adjacent to each of two opposite edges thereof and over a portion located between said two portions, so that two smaller unbent portions are formed between the curved portions. For closing of the tube or pipe, forces are first applied to a pair of the curved portions essentially parallel with one of the said unbent portions and subsequently to a second pair of the curved portions essentially parallel with the second of said unbent portions. Preferably, said prebending then takes place over portions which each corresponds to an arc angle of between 100° and 115°. On account of the elasticity of the plastically deformable material there may after the described closing appear a narrow slot in the tubular blank, which can appropriately be closed with the aid of diametrically counter-directed forces which are applied to the blank so that they will act mainly at right angles to the two lengthwise end surfaces of the slot.

An apparatus for use in closing of the tube or pipe blank provided with at least two portions bent to the wanted curvature of the finished tube or pipe has the form of a closing jig comprising an upwardly open substantially U-shaped press stand and at least two lengthwise bending members disposed diametrally opposite each other on the insides of the substantially vertical stand shanks, at least one of the bending members being displaceable in the direction towards the other. Preferably, each one of the said bending members comprises a pair of mutually parallel and rotatably mounted rollers, a corresponding pair of rollers being provided in the bottom part of the U-shaped stand to support the tubular blanks.

In a preferred embodiment the pair of rollers provided on one stand shank is movable towards the oppositely located pair of rollers by means of a hydraulic cylinder and at least one of the latter pair of rollers and the pair provided in the bottom of the stand is adjustable for adaptation of the jig to different tube or pipe diameters, the rollers in one of the pairs then being arranged to be driven by a motor for rotation of a tubular blank set up in the jig.

DETAILED DESCRIPTION

Figure 1A:
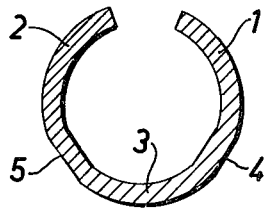
FIGS. 1A–1C illustrate the shape of a tube blank during different steps of formation of the tube.

Shown schematically in FIG. 1A is the shape of a tube blank which is prebent according to the invention. The starting material for the blank according to FIG. 1A is a substantially flat plate, which has been bent in a prior art manner to the wanted radius of curvature over three portions 1, 2 and 3. Of these, portions 1 and 2 commence as close as possible to the edges of the plate blank, whereas portion 3 is located between the portions 1 and 2. The arc angle of the respective portions 1–3 is so chosen that an unbent or substantially straight section 4 and 5 respectively is obtained between adjacent pairs of curved portions. The arc angle of each one of the curved portions is appropriately 100°–115°.

Figure 1B:
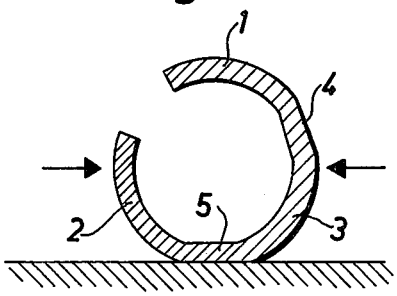
Figure 1C:
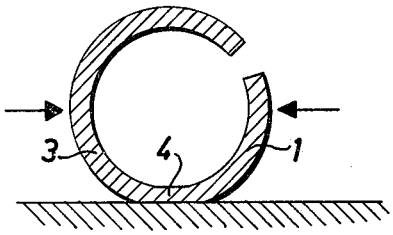

In closing of a tube blank which has been prebent in this manner the procedure illustrated by FIG. 1B and 1C is applied. Firstly, compression forces are applied to one of the pairs of the curved portions 2 and 3, mainly parallel to the straight portion 5, as indicated by the arrows in FIG. 1B. The maximum moment will then occur in the said straight portion 5, which in the deformation which follows will acquire largely the same radius of curvature as the surrounding curved portions 2 and 3. In the next step, FIG. 1C, compression forces are applied to the curved portions 1 and 3 substantially parallel to the straight portion 4, which latter portion 4 will then be bent in the same manner as portion 5 in the previous step. By the method according to the invention the principal deformation thus occurs in closing of a prebent tube blank according to FIG. 1A in the straight portions, for which reason no appreciable further deformation occurs in the portions already bent to the correct curvature, which would otherwise lead to unroundness of the tube.

If on account of the elastic properties of the material a narrow slot should remain after these two closing operations said slot can easily be pressed together, for instance in connection with a subsequent welding operation, without any appreciable unroundness then being obtained, on account of the tiny distance concerned. Such final pressing together of the tube is carried out appropriately with the aid of forces applied largely at right angles to the edge surfaces of the said slot.

Although the above described embodiment, in which the tube blank is provided with three prebent portions and two intermediate straight portions, is preferred, a different number of prebent, curved portions, but at least two, is also conceivable. The essential point is only that the main deformation in closing of a tube blank takes place in unbent portions.

Figure 2:
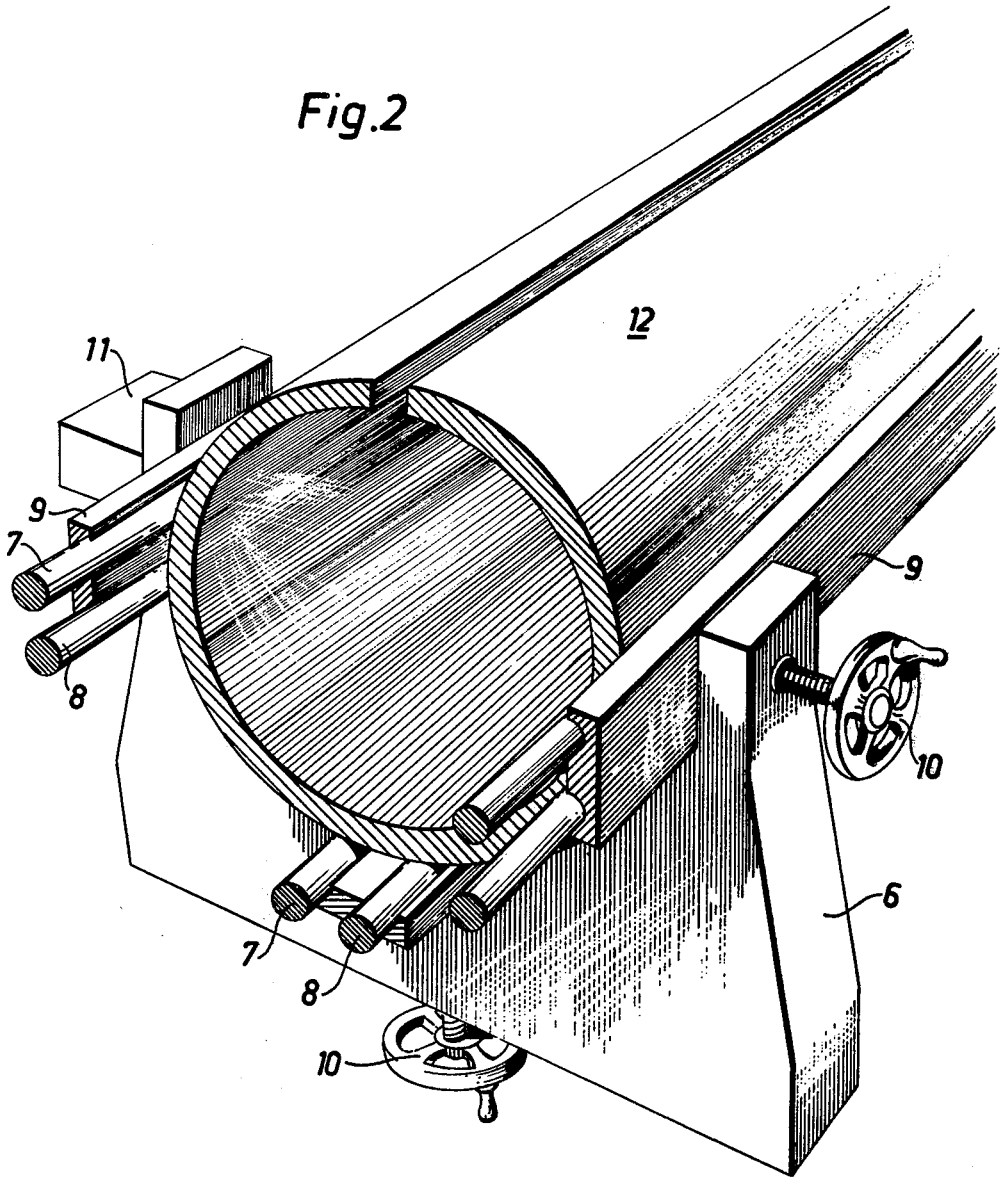
FIG. 2 is a schematic perspective view, partly in section, of a closing jig for use in closing a preshaped tube blank according to FIG. 1A.

In the closing according to FIGS. 1B and 1C of a tube blank prebent according to FIG. 1A, a closing jig according to FIG. 2 can be used. This jig comprises an upwardly extending substantially U-shaped press stand, which appropriately is constructed in the form of a plurality of stand sections 6. The sections 6 support three lengthwise bending and support members, each of which comprises a pair of mutually parallel rollers 7 and 8. Each pair of rollers is rotatably mounted in beam-shaped support and bearing members 9. The seats for the lower and righthand bearing members 9 in FIG. 2 can be adjusted, in the example shown by means of the threaded adjusting members 10 for adaptation of the jig to different tube diameters. The compression force necessary for closing of a tube blank is achieved by means of hydraulic members 11, which are arranged to press the bearing member 9 shown to the left in FIG. 2 with appurtenant rollers 7 and 8 radially in towards the centre of a tube blank 12 set up in the jig.

The pressing operations illustrated in FIGS. 1B and 1C can easily be performed by means of the apparatus according to FIG. 2, since the rollers 7 and 8 arranged at the lower bearing member 9 can be driven from a motor (not shown) for rotation of the tube blank 12 in the closing jig between the different operations. In the shown position the final closing of the tube must take place after the straight sections have been curved.

The adjusting and pressing members provided at the different stand sections 6 should be so designed that they are driven synchronously with each other for obtaining a uniform pressing force over the entire length of the tube. The threaded adjusting members 10 may also be replaced by some other suitable type and, for example, be made hydraulically driven. Both of the diametrally opposite bending members 7–9 can then be arranged to participate in the pressing movement.

The apparatus shown can also be varied in several other respects, so that for instance the setting of the bending members for different cylinder diameters can take place by moving for instance only the lower bearing member 9 with its rollers at an angle of 45° obliquely upwards towards the righthand bearing member shown in FIG. 2. Further, the apparatus should be provided with a suitable measuring device for measurement of tube diameter. The said rollers can also be replaced by lengthwise bending rules. Then, use may appropriately be made of two pairs of rules located diametrally opposite each other, the pressing force then first being achieved between one pair of bending rules and thereafter between the other pair of bending rules. The tube blank does not then need to be rotated between the two pressing operations but can be retained in the same position.

The expression unbent portions used in the above description and in the claims is to be understood to mean only that the tube blank has not been bent over these portions to the wanted radius of curvature of the finished tube in connection with the forming of a tube blank according to FIG. 1A. On the other hand these portions may in certain cases also be curved, for instance in consequence of the original blank not being flat. The curvature of the said portions must however be less than the wanted final radius of curvature of the finished tube.

What we claim is:

1. A method of forming tubes or pipes from a substantially flat blank of a plastically deformable material, comprising:

prebending said substantially flat blank into an essentially tubular form by bending at least two spaced apart portions of the substantially flat blank to substantially the desired curvature of the finished tube or pipe while maintaining at least one substantially flat unbent portion between two of the resulting spaced apart curved portions; and then applying oppositely directed closing forces only to said spaced apart curved portions, without the use of a mandrel interior of said blank, and without completely surrounding the prebent blank, to produce plastic deformation in substantially only the at least one substantially flat unbent portion located between said prebent curved portions to impart substantially the desired final curvature to said substantially flat unbent portions, thereby closing said prebent essentially tubular form into a tube or pipe.

2. A method according to claim 1, wherein the blank is prebent to form curved portions over edge portions adjacent to each one of two opposite edges thereof and over a portion located between said edge portions, so that two smaller, substantially flat unbent portions are obtained between the curved portions, and wherein said closing step comprises first applying oppositely directed closing forces to a pair of the prevent curved portions essentially parallel to one of said substantially flat unbent portions, and subsequently applying said oppositely directed closing forces to a second pair of the prebent curved portions essentially parallel with the second of said substantially flat unbent portions to produce plastic deformation of said substantially flat portions to impart substantially the desired final curvature to said substantially flat unbent portions.

3. A method according to claim 2, wherein said prebending is carried out over portions which each correspond to an arc angle of the order of 100°–115°.

4. A method as claimed in claim 1, comprising a further final closing of a remaining lengthwise slot in the tubular blank which includes applying diametrically opposite forces to the tubular blank, which forces act substantially at right angles to the two lengthwise edge surfaces of said remaining slot.

5. A method according to claim 1, wherein at least two of said prebent curved portions diametrically oppose each other, and said closing forces diametrically oppose each other.

6. A method according to claim 1, wherein said closing step comprises applying said oppositely directed forces to said spaced apart curved portions substantially parallel with said substantially flat unbent portion located between the two curved portions to which said oppositely directed closing forces are applied.

* * * * *